United States Patent [19]

Hofstad

[11] 4,314,498

[45] Feb. 9, 1982

[54] DRUM HAVING INTERNAL DOUBLE ACTING CONTROL TO PROVIDE VARIABLE PITCH

[76] Inventor: David P. Hofstad, 1005 S. Glendale, Sioux Falls, S. Dak. 57105

[21] Appl. No.: 160,206

[22] Filed: Jun. 17, 1980

[51] Int. Cl.[3] ..... G10D 13/02

[52] U.S. Cl. ..... 84/411 A; 84/419

[58] Field of Search ..... 84/411 R, 411 A, 413, 84/415, 419

[56] References Cited

U.S. PATENT DOCUMENTS

| | | | |
|---|---|---|---|
| 1,892,223 | 12/1932 | Sansone et al. | 84/417 X |
| 3,685,389 | 8/1972 | Bemben | 84/411 R |
| 3,951,032 | 4/1976 | La Porta et al. | 84/411 M X |
| 4,023,462 | 5/1977 | Denov et al. | 84/419 X |
| 4,228,721 | 10/1980 | Hancox | 84/411 R |

FOREIGN PATENT DOCUMENTS

| | | | |
|---|---|---|---|
| 610151 | 10/1948 | United Kingdom | 84/411 R |

*Primary Examiner*—Lawrence R. Franklin
*Attorney, Agent, or Firm*—Lucas J. DeKoster

[57] ABSTRACT

A drum with adjustable tension on the drum head in which the adjustment mechanism includes a pedal operating a device adapted to pull a spider within the drum. The legs of the spider are pivoted on the drum body and extend to the exterior. A ring pressing up beneath the head in the interior of the body of the drum is operably attached to the spider legs interior of the pivot point between the leg and the drum body, and members attached to the drum head exterior of the body are pivoted to the legs exterior of the pivot point so that a double acting tension is applied by use of the pedal.

5 Claims, 5 Drawing Figures

DRUM HAVING INTERNAL DOUBLE ACTING CONTROL TO PROVIDE VARIABLE PITCH

BACKGROUND AND SUMMARY OF THE INVENTION

This invention pertains to drums and more particularly to a drum having a head which may be subject to adjustable tension to vary the pitch of the drum.

There are many types of drums having adjustable devices to vary the tension in the head of the drum. These vary from the oldest in which a lacing pulled up the tension of the head to the more modern tympani used by symphony orchestras and the drum sets used by musicians playing modern contemporary music.

Many of the drums used in the modern groups have tension created by pedal operated devices. My invention provides a double acting device in which movement of the pedal is effective in two directions to multiply the effect of small movements. Thus, my device is both more sensitive to movement and allows a wider range of tension in the drum head. I also provide either a mechanical or power operated tensioning device.

FIGURES

DESCRIPTION

Briefly my device comprises a drum mounted on a stand. The drum has an interior spider with pivoted legs acting as double acting levers to actuate means in connection with the head to provide adjustable tension in the head.

Figure 1:
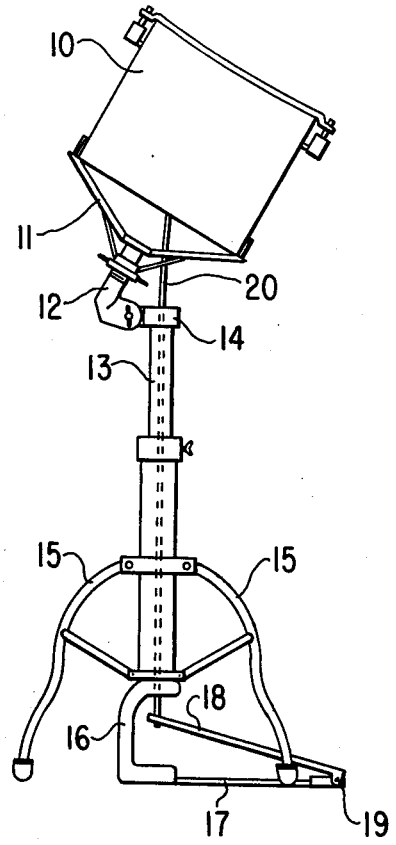
FIG. 1 is an elevational view of the drum of my invention on its stand.

More specifically and referring to the drawings, I provide a drum body 10 mounted on clamping means 11 adapted to grip the body firmly in a manner well known in the art. The base 12 of the clamping means 11 is mounted on the post 13 of the stand for the drum, but is offset as shown in FIG. 1. This is readily done by providing a circular clamp 14 adapted to clamp the upper end of the post 13 and fastened to the base 12 by means of a bolt or the like.

The stand may also be of a type known in the art and consists principally of a center post 13 which may be made adjustable by a telescoping means as shown, and which is mounted on legs 15. These legs may be collapsible for ease of transportation or may be fixed.

At the bottom of the center post 13, and between that post and the floor on which the stand is placed, I provide pedal means for the operation of the head tensioning device. This pedal means includes a bracket 16 mounted on the post and terminating in a floor piece 17. Preferably, this piece is readily detachable from the bracket, or can be collapsed for ease in transporting the set. A pedal 18 is pivotally mounted to this floor piece at its outer end at a pivot point 19.

Figure 3:
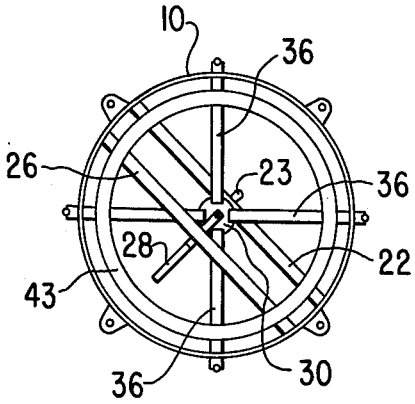
FIG. 3 is a top view of the drum with the head removed.
Figure 2:
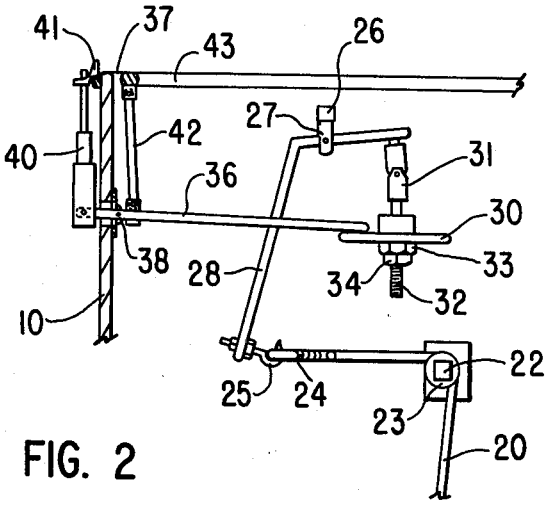
FIG. 2 is a partial sectional view of the drum to show interior mechanism.

A flexible connector 20 such as a cable, wire or cord fastened to the end of the pedal 18 opposite the pivot provides a mechanical connection between the pedal and the tensioning mechanism within the drum body 10. That mechanism is best shown in FIGS. 2 and 3.

Within the body 10 of the drum, I provide a cross shaft 22 on which is mounted a pulley 23. The cable 20 from the pedal runs over the pulley and terminates in a loop 24 engaged over a hook 25. Thus, the cable is easily detachable for repair or when the drum is removed from its stand for transporting it.

A cross bar 26 running across the body 10 and displaced from a diametrical line is also provided. This bar includes a pair of ears 27 between which a bell crank type lever 28 is pivoted. The hook 25 is fastened to the end of one arm of the crank. At the end of the other arm of the lever 28 I provide flexible means to carry a disc 30. This flexible means may be a cable or the like, but is preferably a pair of pivoted links 31 terminating in a screw threaded tang 32. As shown, the tang 32 extends through the disc 30. The position of that disc may be adjusted on the tang by having a threaded portion 33 attached to the disc and may be held in place by a jambnut 34 as is well known in the art.

A number of levers 36 form a spider adapted to transfer motion from the disc 30 to the various means for tensioning the drum head 37. Although I show four legs or levers in the spider, it will be obvious that in the larger units, more legs could be provided and that six or eight might readily be used.

These legs 36 are pivoted to the drum body as at 38 and extend through an opening in the body. At their inner end, they lie on the disc 30 and are adapted to be moved thereby. At their extreme outer end, exterior of the pivot 38, the arms are connected to the drum head through a linkage 40 to the device 41, which holds the drum head. Within the body 10, and interior of the pivot 38 I provide a second linkage 42 carrying a ring 43. This ring lies beneath the drum head 37 and is adapted to press it upwardly when moved through the linkage 42 by the spider legs 36.

It will be obvious that pulling downward on the cable 20 by operation of the pedal 18 will cause a double action on the drum head because of upward pressure from the ring 43 through the linkage 42 and a downward pull on the device 41 through the linkage 40.

Figure 5:
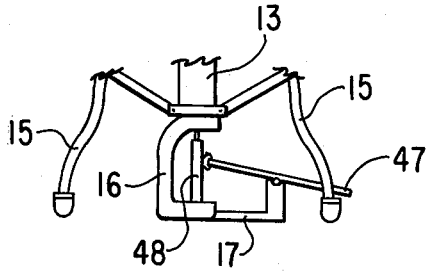
FIG. 5 is a detailed view of the control means for the power operated means.
Figure 4:
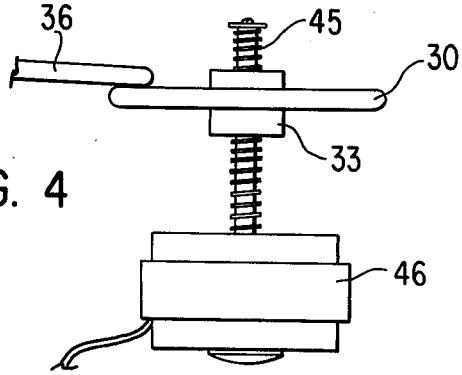
FIG. 4 is a detailed view of a power operated unit which is an alternative to the device of FIGS. 1 and 2.

As an alternative to the mechanical movement of the spider legs 36 by the cable 20 and bell crank 28, I conceive of an electrical device best shown in FIGS. 4 and 5. In that alternative embodiment, the spider and associated tensioning devices are identical to my first described embodiment. The legs 36 of the spider rest on the disc 30 which has a thread hub 33.

The difference between my preferred embodiment and the alternative is that the screw threaded member 45 in the alternative is driven by a small electric motor 46. This motor is mounted within the drum body 10 on a cross member which may be similar to the bar 26 although located at a different part of the drum.

The control for the motor 46 may be located at the base of the stand where the bracket 16 and floor piece 17 may provide a means for mounting a pedal 47. That pedal, in turn is adapted to operate a slide rheostat or potentiometer 48 which is electrically connected to a source of power on one hand and to the motor 46 on the other. This device should also allow the motor to be reversed as well as to control the speed of operation of the motor. Such devices are well within the knowledge of those skilled in the art, and therefore, no details of the control device is shown.

Although I have shown the control for the motor 46 including the pedal 47 at the base of the stand, it is clear that because the only connection is electrical wiring, that control could be placed elsewhere. Thus the control could be placed at a more convenient spot for the drummer, or could even be under control of someone other than the drummer if desired.

I claim:

1. Drum means including a drum body and a drum head stretched over said body, stand means attached to said body and adapted to hold it, said stand means including legs and a central post means supported by said legs, pedal mounting means on said post means, a pedal pivotally mounted on said mounting means, control means including a disc means mounted within said body and operably connected to said pedal, lever means pivoted to said body on a pivot axis adjacent to said body, said lever means extending adjacent to and adapted to be engaged by said disc means, each of said levers extending through an opening in said body and interior and exterior link means attached to each of said levers, said exterior link means being outside of said body and attached to the periphery of said drum head, and said interior link means being within said body and connected to said lever means at a point on the opposite side of said pivot axis from said exterior link means whereby tilting of said lever means about said pivotal axis causes said interior link means to move in a direction opposite to said exterior link means, said interior link means being connected to head tensioning means operably engaged with said drum head interior of said body to press against said head while the exterior link means is pulling on said periphery.

2. The device of claim 1 in which said head tensioning means between said interior link means and said head is through ring means connected to said interior links and engaging said head in close proximity to the interior line of said body adjacent said head.

3. The device of claim 1 in which said operable connection between said disc means and said pedal is effected by lever means pivotally mounted on said drum body, the operating part of said lever means being engaged with said disc means and the operated portion of said lever being connected to said pedal whereby movement of said pedal is transmitted through said lever to move said disc means.

4. The device of claim 3 in which the connection between said pedal and said lever is made by means of flexible tension means extending within said center post means from said pedal to said lever.

5. The device of claim 1 in which said operable connection between said disc means and said pedal is effected by electrical means including a motor, operating means between said motor and said disc means whereby operation of said motor will create linear movement of said flat means and said pedal being operably connected to the operating member of electrical control means, said electrical control means being electrically connected to said motor whereby movement of said operating member by said pedal will control the operation of said motor.

* * * * *